US008509653B2

(12) United States Patent
Nanno

(10) Patent No.: US 8,509,653 B2
(45) Date of Patent: Aug. 13, 2013

(54) FIXING DEVICE AND IMAGE FORMING APPARATUS

(75) Inventor: Shigeo Nanno, Kyoto (JP)

(73) Assignee: Ricoh Company, Ltd., Tokyo (JP)

( * ) Notice: Subject to any disclaimer, the term of this patent is extended or adjusted under 35 U.S.C. 154(b) by 293 days.

(21) Appl. No.: 12/926,658

(22) Filed: Dec. 2, 2010

(65) Prior Publication Data

US 2011/0142495 A1 Jun. 16, 2011

(30) Foreign Application Priority Data

Dec. 16, 2009 (JP) ..... 2009-285243

(51) Int. Cl.
*G03G 15/16* (2006.01)

(52) U.S. Cl.
USPC ..... 399/122

(58) Field of Classification Search
USPC ..... 399/107, 110, 122, 320, 322, 323, 399/328, 329; 219/216, 619
See application file for complete search history.

(56) References Cited

U.S. PATENT DOCUMENTS

| | | | | |
|---|---|---|---|---|
| 7,751,751 | B2 | 7/2010 | Ohta et al. | |
| 7,831,165 | B2 * | 11/2010 | Segawa | 399/69 |
| 2002/0018663 | A1 | 2/2002 | Furukawa et al. | |
| 2006/0045590 | A1 * | 3/2006 | Yamada | 399/329 |
| 2006/0165449 | A1 | 7/2006 | Ito et al. | |
| 2006/0204265 | A1 | 9/2006 | Yoshikawa | |
| 2007/0065201 | A1 | 3/2007 | Fujiwara et al. | |
| 2007/0183798 | A1 | 8/2007 | Moriguchi et al. | |
| 2007/0279888 | A1 | 12/2007 | Nanno et al. | |
| 2007/0285701 | A1 | 12/2007 | Ohta et al. | |
| 2008/0006166 | A1 | 1/2008 | Ohkubo et al. | |
| 2008/0175620 | A1 | 7/2008 | Ohta et al. | |
| 2008/0180760 | A1 | 7/2008 | Andoh et al. | |
| 2008/0180762 | A1 | 7/2008 | Andoh et al. | |
| 2009/0010680 | A1 | 1/2009 | Nanno | |
| 2009/0022516 | A1 | 1/2009 | Ohta et al. | |
| 2009/0060572 | A1 | 3/2009 | Naitoh et al. | |
| 2009/0074440 | A1 | 3/2009 | Nanno et al. | |
| 2009/0110449 | A1 | 4/2009 | Saito et al. | |
| 2009/0129836 | A1 | 5/2009 | Sakaya et al. | |
| 2009/0257769 | A1 | 10/2009 | Miyazaki | |

FOREIGN PATENT DOCUMENTS

| | | |
|---|---|---|
| CN | 1330297 | 1/2002 |
| CN | 101017357 | 8/2007 |
| JP | 2000-81804 | 3/2000 |
| JP | 2004-205417 | 7/2004 |
| JP | 2007-108635 | 4/2007 |
| JP | 2007-212579 | 8/2007 |
| JP | 2008-26677 | 2/2008 |
| JP | 2008-304799 | 12/2008 |
| JP | 2009-15107 | 1/2009 |
| JP | 2009-25464 | 2/2009 |

OTHER PUBLICATIONS

Chinese Office Action dated Sep. 28, 2012.

* cited by examiner

*Primary Examiner* — Hoan Tran
(74) *Attorney, Agent, or Firm* — Harness, Dickey & Pierce, P.L.C.

(57) ABSTRACT

A fixing device includes a fixing roller, a heat roller, an endless fixing belt wound around the two rollers to be driven to rotate, a nip forming member to form a nip while contacting the fixing belt at a position opposite the fixing roller, a pressing member to press the heat roller to separate it from the fixing roller, and a temperature detector to detect a temperature of the fixing belt at a position opposite the heat roller. The temperature detector is provided opposite or in contact with the fixing belt at a position, in parallel with the moving direction of the heat roller, on the outermost periphery of the displacement area of a surface of the fixing belt which displaces according to the approaching and departing movement of the heat roller. With such a simple structure, the temperature detector can detect the temperature of the fixing belt accurately.

17 Claims, 11 Drawing Sheets

FIXING DEVICE AND IMAGE FORMING APPARATUS

CROSS-REFERENCE TO RELATED APPLICATIONS

The present application claims priority from Japanese patent application number 2009-285243, filed on Dec. 16, 2009, the entire contents of which are hereby incorporated by reference herein.

BACKGROUND OF THE INVENTION

1. Field of the Invention

The present invention relates to a fixing device to fix an unfixed image formed on a recording medium as a fixed image onto the recording medium, and an image forming apparatus including such a fixing device.

2. Description of the Related Art

As a fixing device provided to image forming apparatuses such as copiers, printers, facsimile machines, and multifunctional machines including the above functions, there are those provided with a fixing belt stretched over three rollers as disclosed in JP-2007-108635-A and a fixing belt stretched over two rollers as disclosed in JP-2009-25464-A. Specifically, the former fixing belt is stretched over a fixing roller, a heat roller, and a tension roller. The latter fixing belt is stretched over the fixing roller and the heat roller without using the tension roller. Accordingly, the latter realizes greater compactness in the fixing belt. In the 2-roller arrangement, the heat roller also serves as a tension roller to give tension to the fixing belt.

FIG. 20 shows an example of a fixing device in which a fixing belt is stretched over two rollers.

The fixing device as illustrated in FIG. 20 includes a fixing roller 100, a heat roller 200 having a heat source 500 inside thereof, an endless fixing belt 300 stretched over the fixing roller 100 and the heat roller 200, and a pressure roller 400 provided opposite and in contact with the fixing belt 300 so that a nip is formed between the pressure roller 400 and the fixing belt 300.

When an image is fixed by this fixing device, first, the pressure roller 400 is driven to rotate by a driving motor, not shown, and the fixing belt 300, the fixing roller 100, and the heat roller 200 are driven by the driving of the pressure roller 400. Then, a sheet of a recording medium P on which an unfixed toner image T is carried is conveyed to the nip between the fixing belt 300 and the pressure roller 400 in the direction shown by the broken line arrow, and toner images T are fixed on the surface of the recording medium P with heat and pressure.

In addition, as illustrated in FIG. 20, the fixing device is in general provided with a temperature detector 600 such as a thermistor or a thermostat to detect a temperature of the fixing belt 300. Based on the temperature detected by the temperature detector 600, the fixing belt 300 is maintained at a predetermined temperature target value and is prevented from being heated excessively. The temperature detector 600, which may or may not contact the fixing belt, is provided opposite the heat roller 200 so that the temperature of the heated part of the fixing belt 300 may be detected easily. Further, to detect the temperature with higher precision, a fixed, constant distance between the non-contact temperature detector and the fixing belt, or a fixed, constant contact pressure between the contact temperature detector and the fixing belt are preferably retained.

However, in the fixing device of the type in which the fixing belt is stretched over two rollers as illustrated in FIG. 20, the heat roller 200 serves as a tension roller. Therefore, when the fixing belt 300 expands or shrinks due to changes in temperature, the heat roller 200 is designed to move toward or away from the fixing roller 100 in order to adjust the tension on the fixing belt 300. As a result, as illustrated in FIG. 21, if the heat roller 200 moves from its home position in the X- or Y-direction to positions indicated as 200X or 200Y, the distance between the temperature detector 600 and the fixing belt 300 changes also, and as a result the temperature cannot be detected precisely. The same outcome occurs if a contact-type temperature detector is used, in that the contact pressure between the temperature detector and the fixing belt changes due to the movement of the heat roller. In this case also, the temperature cannot be detected precisely. Moreover, when the fixing belt is rotated in a state in which the contact pressure between the temperature detector and the fixing belt increases, the surface of the fixing belt may be scratched by contact with the temperature detector.

In order to solve the above-described problem, JP-2000-81804-A discloses a technology in which the temperature detector is integrated into the heat roller via a support member. Accordingly, even though the heat roller moves, since the temperature detector moves integrally with the heat roller, the distance between the heat roller and the temperature detector remains constant. However, a support member to connect the temperature detector with the heat roller is needed. Thus, the number of parts and assembly steps increase, hindering efforts at more compactness or lower manufacturing cost cannot be realized.

SUMMARY OF THE INVENTION

Accordingly, the present invent ion provides a novel fixing device, with a simple structure, capable of detecting the temperature of the fixing belt with higher precision, and a novel image forming apparatus provided with such a fixing device.

A fixing device according to the present invention includes a fixing member, a heating member configured to approach and withdraw from the fixing member, an endless fixing belt, wound around the fixing member and the heating member so as to be rotatable, a nip forming member to form a nip while contacting the fixing belt at a position opposite the fixing member, a pressing member to press the heating member so as to separate it from the fixing member, and a temperature detector to detect a temperature of the fixing belt at a position opposite the heating member. The temperature detector is positioned such that either a distance or a contact pressure between the temperature detector and the fixing belt remains substantially constant when the heating member moves from a first position to a second position in a movable range thereof in the approaching and withdrawing direction with respect to the fixing member. Further, the temperature detector is provided at a position on an outermost periphery of a displacement area of a surface of the fixing belt which displaces in accordance with the moving of the heating member that approaches and withdraws from the fixing member and parallel to the moving direction of the heating member, and is so provided as to be opposite or in contact with the fixing belt.

Thus, even though the surface of the fixing belt displaces according to the movement of the heating member, the distance or the contact pressure of the temperature detector with respect to the fixing belt is kept substantially constant.

Accordingly, variations in the detected temperature by the temperature detector can be restricted within an allowable range, thereby enabling detection of the temperature of the fixing belt with higher precision and preventing malfunction of the apparatus due to erroneous temperature detection by the temperature detector. In addition, damage to the fixing belt due to the excessively strong contact with the temperature detector may be prevented. Therefore, by preventing malfunction of the apparatus and damage to the fixing belt, a highly reliable fixing device and image forming apparatus can be provided.

These and other objects, features, and advantages of the present invention will become apparent upon consideration of the following description of the preferred embodiments of the present invention when taken in conjunction with the accompanying drawings.

DESCRIPTION OF THE PREFERRED EMBODIMENTS

Figure 1:
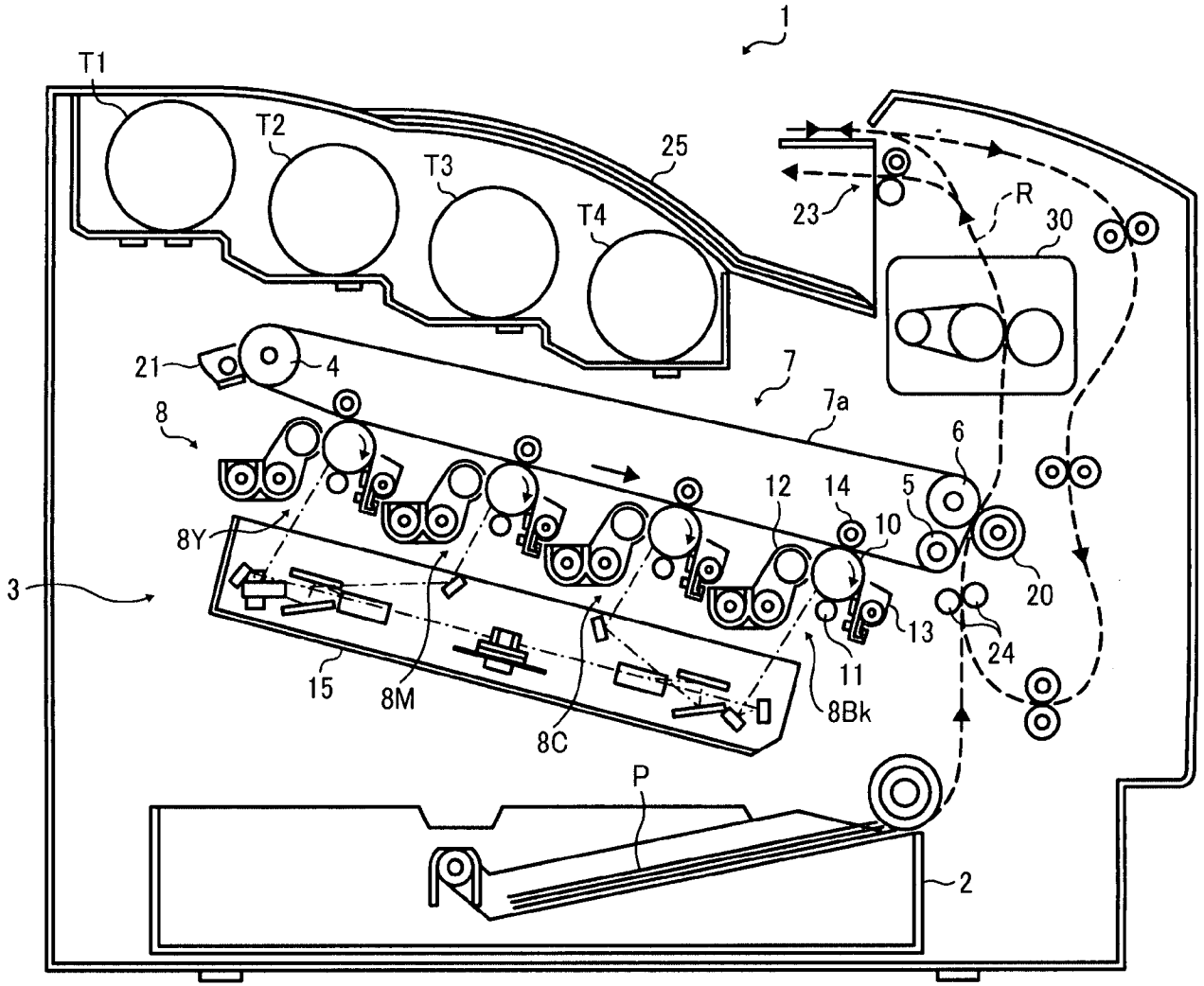
FIG. 1 shows a general configuration of an image forming apparatus according to one embodiment of the present invention.

An embodiment of the present invention will now be described with reference to drawings. In each of the drawings, the same reference numeral is applied to the same or corresponding parts and duplicate explanation thereof is simplified or omitted.

FIG. 1 shows a general configuration of an image forming apparatus according to one embodiment of the present invention. This image forming apparatus is an electrophotographic color printer (hereinafter, printer) using a tandem method and capable of forming a full-color image. As an image forming apparatus, a copier, a facsimile machine, or a multifunction machine combining these functions may also be used, and thus the image forming apparatus is not limited to the printer as illustrated in FIG. 1.

Referring to FIG. 1, the basic structure and operation of the printer will now be described. Thereafter, the structure and effect specific to the present invention will be described.

This printer includes an image forming apparatus body 1 as a base, a sheet feed section or a sheet feed cassette 2 provided below the image forming apparatus body 1 and containing recording sheets P as recording media, and an image forming section 3 provided above the image forming apparatus body 1. The image forming section 3 includes an imaging section 8, an intermediate transfer unit 7, an optical writing unit 15, and a fixing device 30. The imaging section 8 includes four image forming units, 8Y, 8C, 8M, and 8Bk, as a plurality of image forming means each including an image carrier. The intermediate transfer unit 7 includes an intermediate transfer belt 7*a* as a flexible endless belt wound around a plurality of rollers 4, 5, and 6. The optical writing unit 15 serves as an optical writing section to optically write images on each image carrier. The fixing device 30 serves to fix a toner image onto a recording sheet P. The image forming units 8Y, 8C, 8M, and 8Bk and the intermediate transfer unit 7 are detachably provided with respect to the apparatus body 1. A conveyance path R in which the recording sheet P is conveyed is formed from a sheet feed section 2 to the fixing device 30. The roller 6 is provided in contact with the conveyance path R. In the present configuration, the intermediate transfer unit 7, the imaging section 8, the optical writing unit 15, and the fixing device 30 are components inside the image forming apparatus and provided substantially in the center of the apparatus body 1.

The portion of the intermediate transfer belt 7*a* between the roller 4 and the roller 5 corresponds to a lower belt running side. A secondary transfer roller 20 as a secondary transfer device is provided at a position opposite the roller 6 with the conveyance path R sandwiched therebetween. A belt cleaning device 21 serving to clean the belt surface is provided opposite the roller 4.

The imaging section 8 is provided below the intermediate transfer belt 7*a*. Each image forming unit includes a photoreceptor drum 10 and an image carrier contacting the intermediate transfer belt 7*a*, and further includes a charger 11, a developing device 12, and a cleaner 13, which are provided around each photoreceptor drum 10. A primary transfer roller 14 serving as a primary transfer means is provided at an inner side of the intermediate transfer belt 7*a* at a position corresponding to each photoreceptor drum.

In the present embodiment, each image forming unit 8Y, 8C, 8M, and 8Bk has the same basic structure, differing only in the color of toner contained therein as a developer, in each developing unit 12. Accordingly, as illustrated in FIG. 1, only the image forming unit 8Bk is supplied with reference numerals as a representative unit. Each image forming unit 8Y, 8C, 8M, and 8Bk has a developing device 12 corresponding to one of the toner colors of yellow, cyan, magenta, and black. When the toner amount included in each developing device 12 becomes low, the developing device 12 is supplied with toner from a corresponding one of toner supply bottles T1, T2, T3, and T4.

The optical writing unit 15 serves to irradiate the surface of each photoreceptor drum with light-modulated laser beams to form a latent image of each color thereon. In the present embodiment, the optical writing unit 15 is provided below the imaging section 8.

The toner supply bottles T1, T2, T3, and T4, the intermediate transfer unit 7, the imaging section 8, and the optical writing unit 15 are all slanted at the same angle to the horizontal inside the apparatus body 1, thereby reducing the installed area compared to a case in which these components are horizontally provided in the apparatus body 1.

When the image forming operation is started, the photoreceptor drum 10 of each image forming unit 8 is driven to rotate in the clockwise direction via a driving device, not shown, and the surface of each photoreceptor drum is uniformly charged with a predetermined polarity by the charger 11. The optical writing unit 15 radiates later beams to irradiate the surface of each charged photoreceptor drum, thereby forming electrostatic latent images on each surface thereof. In this case, the image information exposed on each photoreceptor drum is monochrome image information separated from a desired full-color image into color information of each of yellow, cyan, magenta, and black. The thus-formed electrostatic latent image is rendered visible as a toner image by the toner in each developing device 12 when passing between each photoreceptor drum and developing device 12.

Among the plurality of rollers 4, 5, and 6, over which the intermediate transfer belt 7*a* is stretched, one of the rollers is driven to rotate in the counterclockwise direction by a driving device, not shown, whereby the intermediate transfer belt 7*a* is driven in a counterclockwise direction as shown by arrows in FIG. 1 and other rollers are driven to rotate by the intermediate transfer belt 7*a*. The image forming unit 8Y including the developing device 12 containing the yellow toner forms a yellow toner image, which is transferred to the intermediate transfer belt 7*a* by a primary transfer roller 14. Onto the transferred yellow toner image, a cyan toner image, a magenta toner image, and a black toner image, formed respectively by the image forming unit 8C, 8M, and 8Bk, are sequentially overlaid and transferred, whereby a full-color toner image is carried on the intermediate transfer belt 7*a*.

The residual toner deposited on the surface of each photoreceptor drum after primary transfer of the toner image is then removed from the surface thereof by the cleaner 13. Subsequently, the surface of the photoreceptor drum is subjected to a discharging operation by a discharger, not shown, and the surface potential is initialized and the photoreceptor drum is prepared for a next image formation.

A recording sheet P supplied from the sheet feed section 2 is conveyed to the conveyance path R, and further conveyed to a position between the roller 6 and the secondary transfer roller 20 at a timing adjusted by a registration roller pair 24 provided at a position nearer to the sheet feed side than to the secondary transfer roller 20. In this case, the secondary transfer roller 20 is supplied with a transfer voltage having a polarity opposite the charged polarity of the toner of the toner image on the surface of the intermediate transfer belt 7*a*. Accordingly, the toner image on the surface of the intermediate transfer belt 7*a* is transferred onto the recording sheet P en bloc. The recording sheet P on which the toner image has been transferred is then transferred to the fixing device 30. When passing through the fixing device 30, the recording sheet P is heated and pressed, fusing the toner image and fixing it on the recording sheet P. The recording sheet P on which the toner image is fixed is conveyed to a discharge section 23 provided at the end of the conveyance path R and is discharged onto a stack section 25 provided at an upper side of the apparatus body 1. The surface of the intermediate transfer belt 7*a*, of which the toner image thereon has been transferred to the recording sheet P, is cleaned by the cleaning device 21, which removes the residual toner on the intermediate transfer belt 7*a*.

The thus-configured printer includes four image forming units 8Y, 8M, 8C, and 8Bk provided opposite the intermediate transfer belt 7*a*, in which each color toner image is transferred sequentially on the intermediate transfer belt 7*a*. Therefore, compared to the type of printer including one image forming unit and four developing devices, in which toner images superimposed one atop the other on the intermediate transfer belt and the superimposed toner images are transferred onto the recording sheet, the image forming time can be drastically shortened. Moreover, since the stack section 25 is formed at the upper side of the apparatus body 1, the stack section 25 does not protrude from the apparatus body 1, thereby reducing the mount area occupied by the image forming apparatus.

The above description relates to a full-color image forming operation. However, using any one of the image forming units in the imaging section 8, a monochrome image may be formed. Otherwise, a two-color image or three-color image may also be formed. Monochrome printing using the printer according to the present embodiment is performed such that the electrostatic latent image is formed only on the photoreceptor drum in the image forming unit 8Bk, is developed by the same unit and transferred to the recording sheet P, and is fixed by the fixing unit 30.

Next, the fixing device 30 of the belt fixing method according to the present embodiment will now be described in detail.

Figure 2:
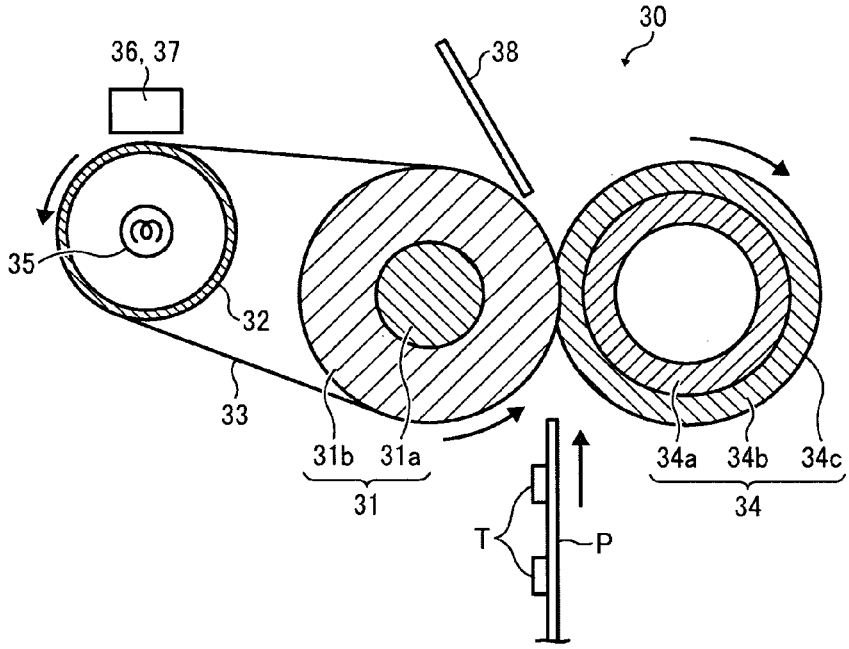
FIG. 2 is a cross-sectional view of a fixing device according to one embodiment of the present invention.

As illustrated in FIG. 2, the fixing device 30 includes a fixing roller 31 as a fixing member, a heat roller 32 as a heating member, an endless fixing belt 33 stretched over the fixing roller 31 and the heat roller 32, a pressure roller 34 as a nip forming member to form a nip by pressing against the fixing belt 33 at a position opposite the fixing roller 31, and a thermistor 36 and a thermostat 37 (bimetal) together functioning as a temperature detector to detect a temperature of the fixing belt 33.

The fixing roller 31 includes a metal core 31*a* formed of SUS304 and the like, and an elastic layer 31*b* formed of a foam member such as a foamed silicon rubber and the like around the core. The elastic layer 31*b* is formed by a foamed member so that a nip width or amount in the nip portion may have a comparatively large area and the heat in the fixing belt 33 does not transfer to the fixing roller 31 easily. In the present embodiment, the fixing roller 31 has an outer diameter of 29 mm and the elastic layer 31*b* has a thickness of 8.5 mm. The heat roller 32 is a hollow cylinder made of a metal material such as aluminum or stainless steel, with a wall thickness of 1 mm or less. In the present embodiment, the heat roller 32 is formed of aluminum having a thickness of 0.6 mm, and the heat roller 32 has an outer diameter of 20 mm. A halogen heater 35 as a heat source is arranged inside the heat roller 32. The halogen heater can also be provided inside the pressure roller 32 similarly to the case of the fixing roller 31. The wall thickness of the heat roller 32 is set to be 1 mm or less in order to reduce its thermal capacity, thereby improving the temperature-raising capability of the apparatus by reducing the rise time required.

The fixing belt 33 includes a base member formed of a resin such as polyimide and having a thickness of 50 to 150 μm, an elastic layer provided on the base member and formed of silicon rubber with a thickness of 100 to 200 μm, and a release layer provided on the silicon rubber layer and formed of fluoropolymers such as tetrafluoroethylene-perfluoroalkylvinyl ether copolymer (PFA), fluorinated ethylene propylene (FEP), polytetrafluoroethylene (PTFE), or the like, with a thickness of 20 to 50 μm. Alternatively, the fixing belt 33 may be formed only of the resin or metallic base member in order to reduce the thermal capacity.

The fixing belt 33 is formed to have a minimum peripheral length to reduce the thermal capacity. The outer diameter of the fixing roller 31 is preferably larger than that of the heat roller 32 to secure a nip width necessary for satisfactory fixing performance, and the heat roller 32 is made as small as possible so as not to interfere with the halogen heater 35 provided inside thereof.

The pressure roller 34 is pressed by a spring, not shown, with a load of 40 to 80 kgf against the fixing roller 31, thereby forming a nip. In addition, the pressure roller 34 includes a metal core 34*a* formed of aluminum or iron and an elastic layer 34*b* formed of an aquiform or foamed silicon with a thickness of 2 to 6 mm surrounding the metal core 34*a*. In the present embodiment, the outer diameter of the pressure roller 34 is 30 mm and the thickness of the silicon layer is 3.5 mm. The surface layer of the pressure roller 34 is a release layer 34*c* formed of PFA, PTFE, and the like. The surface hardness of the pressure roller is 10 to 70 Hs on the Asker C hardness scale.

A separation plate 38 serving to separate the recording sheet from the fixing belt 33 is provided at a position facing the peripheral surface of the fixing belt 33 and in the vicinity of an outlet of the nip. The separation plate 38 is so provided as to be separated from the fixing belt 33 by a predetermined gap in the widthwise imaging area. In the present embodiment, the gap between the separation plate 38 and the fixing belt 33 is set at 0.3 mm or so. In addition, both ends of the separation plate 38 in the widthwise direction are configured to contact non-imaging areas of the fixing belt 33. Thus, by providing a separation plate 38 which does not contact the imaging area of the fixing belt 33, without adversely affecting the formed image, a phenomenon in which the recording sheet after passing through the fixing process winds around the fixing belt 33 may be prevented.

The thermistor 36 and the thermostat 37, respectively, are provided at a position opposite the heat roller 32 and separated from the peripheral surface of the fixing belt 33 by a predetermined distance. They are fixed to a frame, not shown, provided on the fixing device. Further, in the present embodiment, the thermistor 36 and the thermostat 37 are provided above the heat roller 32 so that the temperature of the heat rising from the fixing belt 33 can be detected easily.

The thermistor 36 serves to detect changes in the temperature of the fixing belt 33 so as to maintain the temperature of the fixing belt 33 at a constant predetermined level. Specifically, the temperature of the fixing belt 33 detected by the thermistor 36 is transmitted to a controller such as a CPU provided in the image forming apparatus that controls activation of the halogen heater 35 inside the heat roller 32 based on the temperature, whereby the fixing temperature of the fixing belt 33 is maintained at a desired, target temperature. It is to be noted that the, instead of the thermistor, a thermopile may be used. However, the thermistor is preferable because of its compactness and low cost.

The thermostat 37, upon detecting that the fixing belt 33 is overheating, serves as a means to prevent excessive temperature rise by shutting off the power supply to the halogen hater 35. In the present embodiment, upon the ambient temperature of the fixing belt 33 reaching approximately 185° C., the thermostat 37 shuts off the power supply to the halogen heater 35.

Figure 3:
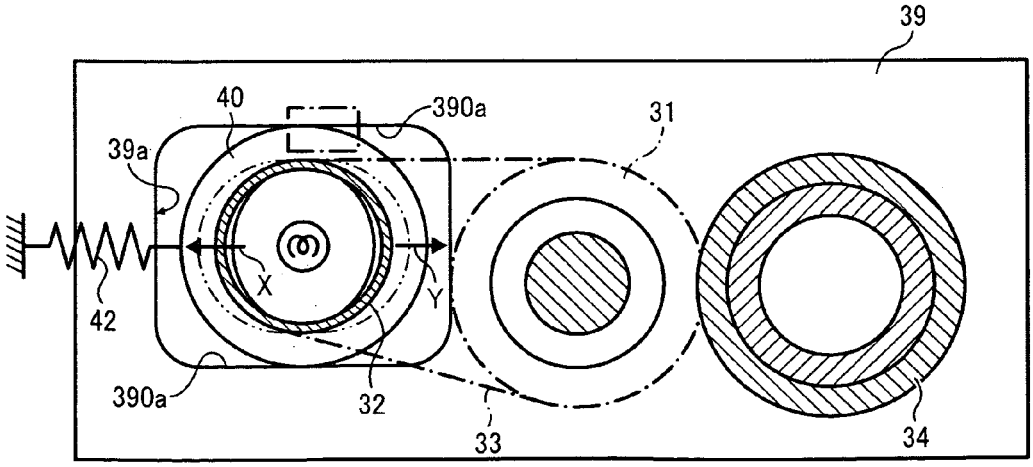
FIG. 3 is a view showing a supporting structure of the fixing device.

FIG. 3 shows a support structure of the fixing roller 31, the heat roller 32 and the pressure roller 34.

As illustrated in FIG. 3, a support member 39 supporting the fixing roller 31, the heat roller 32, and the pressure roller 34 is a side plate forming part of a frame of the fixing device. The fixing roller 31 is rotatably supported at the side plate 39 by a roller bearing, not shown. The heat roller 32 is rotatably supported by a roller bearing 40 which is inserted in a guide opening 39*a* formed in the side plate 39. The guide opening 39*a* is formed longitudinally in the widthwise direction of FIG. 3. The roller bearing 40 is formed to be movable in the longitudinal direction as indicated by arrows X and Y along a guide portion 390*a* extending widthwise as illustrated in FIG. 3. Thus, since the roller bearing 40 is movable along the guide opening 39*a*, the heat roller 32 approaches and withdraws from the fixing roller 31.

In addition, the heat roller 32 is pressed in the X-direction away from the fixing roller 31. In the present embodiment, as a pressing means, a tension spring 42 is provided to pull the heat roller 32 with a load of 2 to 20 kgf. However, the pressing means is not limited to the tension spring, and, for example, a compression spring may be used to press the heat roller 32. When the heat roller is pulled by the tension spring 42, the fixing belt 33 is given a predetermined tension.

The direction in which the heat roller 32 is biased by the tension spring is preferably set to be substantially parallel to the moving direction of the heat roller 32, that is, the X- or Y-direction. As the pressing angle with respect to the moving direction of the heat roller 32 increases, the loss in the pressing force also increases, thereby increasing the size and the manufacturing cost of the apparatus. By contrast, if the pressing direction of the heat roller 32 is set to be parallel to the moving direction of the heat roller 32, the pressing angle with respect to the moving direction of the heat roller 32 becomes minimal, thereby decreasing the loss of the pressing force and reducing the size and the manufacturing cost of the apparatus.

It is preferable to set the pressing direction of the heat roller 32 to be substantially parallel to but slightly deviated from the moving direction of the heat roller 32, rather than setting it to be completely parallel. In FIG. 3, although the distance between the upper and lower guide portions 390*a* is represented as being the same as the outer diameter of the roller bearing 40, in fact, the distance between the guide portions 390*a* is slightly larger than the outer diameter of the roller bearing 40 so as to secure the slidability of the roller bearing 40 in the guide opening 39*a*. Accordingly, to move the roller bearing 40 along either of the guide portions 390*a*, the pressing direction of the heat roller 32 needs to be slightly slanted in the upward or downward direction in the figure in the moving direction thereof. Accordingly, the pressing direction of the heat roller 32 is preferably set to be substantially though not completely parallel to the moving direction.

Meanwhile, the halogen heater 35 in the heat roller 32 is fixed to the frame of the fixing device. Accordingly, if the heat roller 32 moves along the guide opening 39*a*, there is a possibility that the halogen heater 35 and the heat roller 32 may interfere with each other. The position of the heat roller 32 with respect to the halogen heater 35 changes due to deviations of the outer diameter of the heat roller 32 and the fixing roller 31, variations in the peripheral length of the fixing belt 33, variations in the dimensional and assembly precision of the side plate 39 supporting each roller, thermal expansion of the above parts, and the like. However, the moving amount of the heat roller 32 due to the above various factors is predictable considering the precision of respective parts and components, expansion ratios of materials for those parts and components, and the like. By dimensioning appropriately the outer diameter of the heat roller 32 based on the predicted moving amount due to the above various factors, the halogen heater 35 and the heat roller 32 are prevented from interfering with each other.

The pressure roller 34 is rotatably supported by a roller bearing, not shown. This roller bearing is movably supported at the side plate 39 so that the pressure roller 34 approaches to and departs from the fixing roller 31. The pressure roller 34 approaches to and departs from the fixing roller 31, whereby the pressure roller 34 is pressed against or is released from indirect contact with the fixing belt 33. With the apparatus as configured as described above, when sheet clogging occurs, for example, the pressure roller 34 is separated from the fixing belt 33 to be released from indirect contact with the pressure roller 34, thereby facilitating removal of the clogged recording sheet.

In addition, the pressure roller 34 is configured to be a driving roller which is rotatably driven by a driving motor, not shown. When the pressure roller 34 is driven to rotate in the clockwise direction as illustrated in FIG. 2, the fixing belt 33 rotates accompanied by the pressure roller 34, and the fixing roller 31 and the heat roller 32 rotate accompanied by the fixing belt 33 in the counterclockwise direction. Thus, as configured above, the driving system may be simplified. In addition, instead of using the pressure roller 34 as a driving roller, it is also possible that the fixing roller 31 may be configured as the driving roller.

Referring to FIG. 2, a fixing operation of the fixing device 30 according to the present embodiment will now be described.

First, an alternating current is supplied to the halogen heater 35 from a power source, not shown, provided in the image forming apparatus body, to thus generate heat in the halogen heater 35. The heat roller 32 is heated by heat radiated from the halogen hater 35 thus activated. Next, the heat of the heat roller 32 is transmitted to the fixing belt 33 to heat the fixing belt 33. The output of the halogen heater 35 is controlled based on the detection result of the belt surface temperature by the thermistor 36 so that the fixing temperature of the fixing belt 33 becomes a desired, target temperature.

Thereafter, the pressure roller 34 is driven to rotate in the clockwise direction in FIG. 2, thereby rotating the fixing belt 33, the fixing roller 31, and the heat roller 32 in the counterclockwise direction, respectively. A recording sheet P on which an unfixed toner image T is carried is inserted into a nip formed between the pressure roller 34 and the fixing belt 33. Then, the toner image T on the recording sheet P is heated by the fixing belt 33 and pressed by the fixing belt 33 and the pressure roller 34, whereby the toner image T is fixed on the surface of the recording sheet P.

Even in the event that heater control is not performed correctly due to failure of the thermistor 36, for example, the thermostat 37 shuts off the power supply to the halogen heater 35 upon the ambient temperature of the fixing belt 33 reaching approximately 185° C. Thus, the temperature of the fixing belt 33 is prevented from rising an abnormal temperature (for example, 250° C.) that damages the fixing belt 33 and others.

Figure 4:
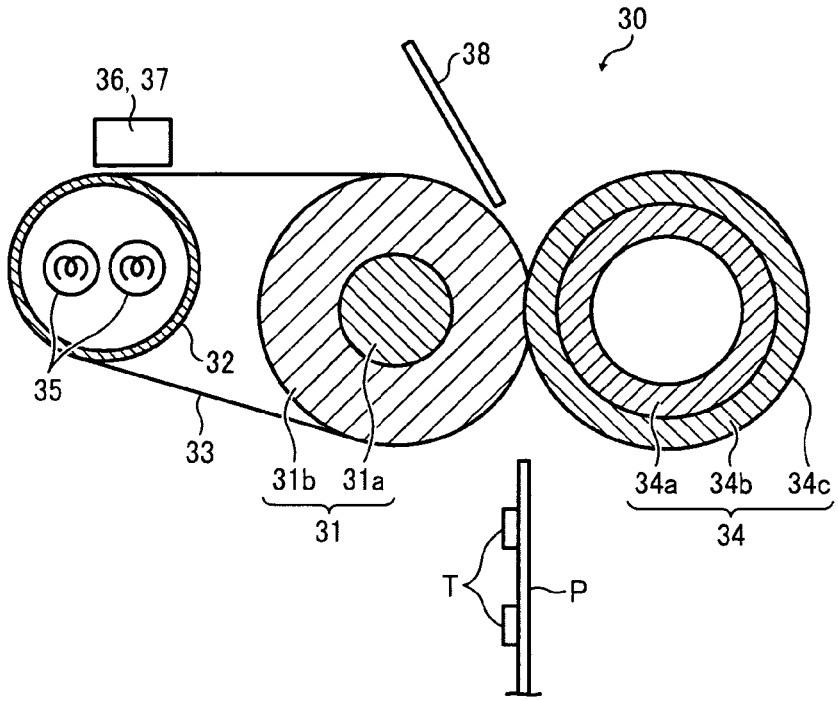
FIG. 4 is a view in which a heat roller of the fixing device includes a plurality of halogen heaters.

As illustrated in FIG. 4, a plurality of halogen heaters 35 is provided inside the heat roller 32. For example, one halogen heater having a rated capacity of 700 watts and another having a rated capacity of 300 watts are provided as a set of halogen heaters 35. Accordingly, the total wattage of the halogen heater 35 can be increased, and the rising time or the warming-up time of the device can be shortened.

Figure 5:
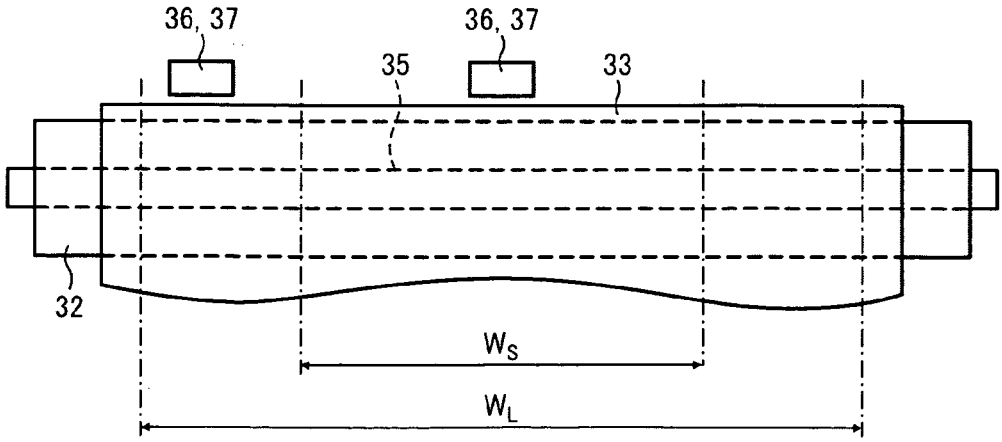
FIG. 5 is a view showing a plurality of temperature detecting means for the fixing device.

As illustrated in FIG. 5, if the fixing device is configured to pass recording sheets with different widths, it is preferable that a sheet passage area $W_L$ for the large-sized sheet (that is, a recording sheet having a large width) and another sheet passage area $W_S$ for the small-sized sheet (that is, a recording sheet having a small width) of the fixing belt 33 be heated separately. Although either of the large-sized sheet and the small-sized sheet maybe selected, if, in a case where only the large-sized sheet can be heated, the small-sized sheets are continuously passed, the fixing belt 33 may be overheated locally in the area in which the small-sided sheets do not pass. In the so-called center reference conveyance method as illustrated in FIG. 5, in which the centers of each of the small-sized sheet and the large-sized sheet in the widthwise direction are aligned and conveyance is performed, a localized temperature rise occurs at both ends of the fixing belt 33 due to the continuous passage of the small-sized sheets.

Then, the central portion of the widthwise direction of the fixing belt 33 in which the small-sized sheets pass and the two end portions in which the small-sized sheets do not pass are configured to be heated separately. Then, when the small-sized sheets are continuously passed, only the central portion of the widthwise direction of the fixing belt 33 is heated, thereby preventing the excessive temperature rise in the two end portions from occurring.

In addition, if the central portion and the two end portions of the fixing belt 33 are configured to be heated separately, the thermistor 36 and the thermostat 37 need to be provided one piece each at the central portion in the widthwise direction and the end portion in the widthwise direction of the fixing belt 33. Thus, the temperatures at the central portion in the widthwise direction and the end portion in the widthwise direction of the fixing belt 33 are detected separately, thereby performing temperature adjustment and overheat prevention of the fixing belt 33 effectively and securely.

In addition, the image forming apparatus according to the present invention is not limited to the center-referenced conveyance method as illustrated in FIG. 5. The image forming apparatus of the present invention may adopt a so-called end-referenced conveyance method in which different-sized sheets are conveyed with an edge of the sheet in the widthwise direction matched with each other.

Figure 6:
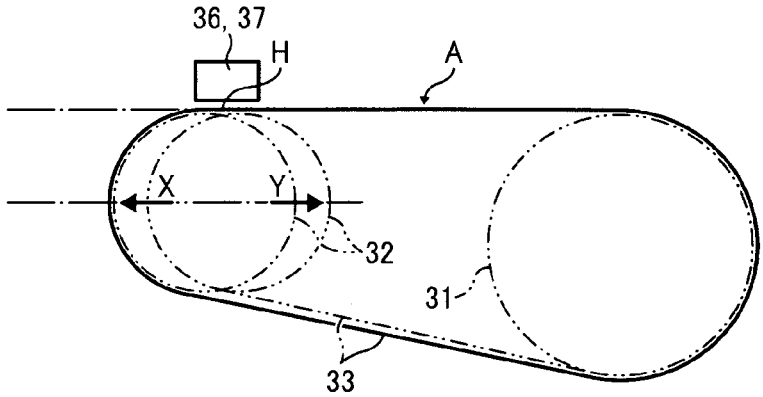
FIG. 6 is a view showing a state in which the heat roller moves in the fixing device.

FIG. 6 is a diagram showing a state in which the heat roller 32 of the fixing device in the present invention moves. The pressure roller 34 and the separation plate 38 are omitted in the figure.

When the fixing belt 33 expands or shrinks due to heating and cooling, the heat roller 32 moves in a direction approaching to or departing from the fixing roller 31 (X- or Y-direction in the figure) in order to maintain the tension on the fixing belt 33. In this case, in accordance with the movement of the heat roller 32, the position of the surface of the fixing belt 33 also displaces. A solid line A in FIG. 6 shows an outermost periphery of the displacement area of the thus displaced fixing belt 33. A portion H is on the outermost periphery A of the displacement area of the fixing belt 33 and is parallel to the moving X- or Y-direction of the heat roller 32. In the present embodiment, the thermistor 36 and the thermostat 37 are provided opposite the fixing belt 33 at the portion H parallel to the moving direction of the heat roller 32. Furthermore, since the moving direction of the heat roller 32 is configured to be parallel to the upper flat surface of the fixing belt 33 in FIG. 6, the parallel portion H exists over the upper flat surface of the fixing belt 33. However, the thermistor 36 and the thermostat 37 are provided at a position opposite the heat roller 32 at that portion of portion H parallel to the flat surface of the fixing belt 33.

Since the thermistor 36 and the thermostat 37 (hereinafter simply "thermistor 36") are provided as described above, even when the heat roller 32 moves in a direction approaching to or departing from the fixing roller 31, the distance between the thermistor 36 and the fixing belt 33 may be kept constant.

Figure 7A:
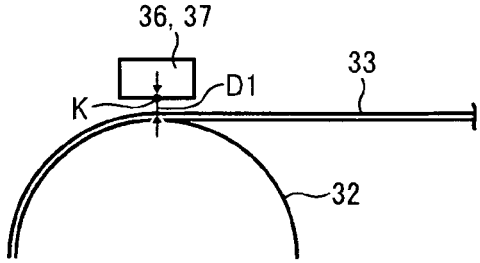
FIGS. 7A and 7B are enlarged views of the fixing device of FIG. 6.
Figure 7B:
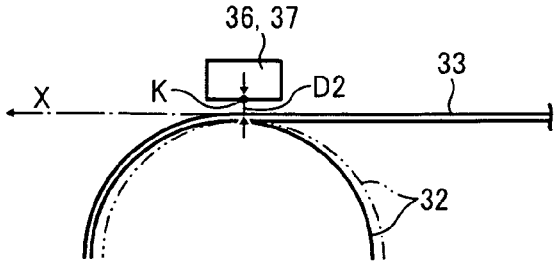

Specifically, if the heat roller 32 moves from a state as illustrated in FIG. 7A to a state in FIG. 7B, the surface of the fixing belt 33 also displaces accordingly. In this case, the portion of the fixing belt 33 opposite the thermistor 36 expands in parallel with the moving X-direction of the heat roller 32. Then, a distance D1 between a detection point K of the thermistor 36 and the outer periphery of the fixing belt 33 before displacement as illustrated in FIG. 7A is the same as a distance D2 between a detection point K of the thermistor 36 and the outer periphery of the fixing belt 33 after displacement as illustrated in FIG. 7B. Similarly, in a case in which the fixing belt 33 shortens and moves in a reverse direction, the portion of the fixing belt 33 opposite the thermistor 36 moves in parallel to the moving X-direction in FIG. 7B. Then, the distance between the thermistor 36 and the fixing belt 33 before and after the displacement does not change and remains at a constant level in the embodiment of the present invention.

Figure 8A:
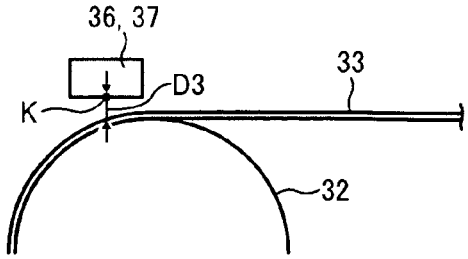
FIGS. 8A and 8B are other enlarged views of the fixing device.
Figure 8B:
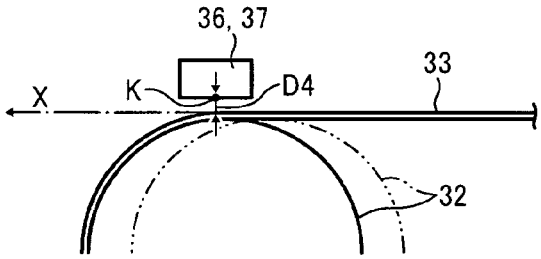

As illustrated in FIG. 8A, there is a case in which the detection point K of the thermistor 36 exists opposite the curved surface of the fixing belt 33 wound around the heat roller 32 instead of at top dead center if the heat roller 32 as described previously. In this case, as illustrated in FIG. 8B, if the heat roller 32 moves, the thermistor 36 comes to a position opposite the flat surface of the fixing belt 33. Therefore, a distance D3 between the thermistor 36 and the fixing belt 33 before displacement is slightly different from a distance D4 between the thermistor 36 and the fixing belt 33 after displacement. This change in the distance may affect the accuracy of the temperature detection performed by the thermistor 36. However, by adjusting the position of the thermistor 36, the effect can be restricted within an allowable range. In a case in which the heat roller 32 moves toward the X-direction in the figure from the state as illustrated in FIG. 8B, the distance between the thermistor 36 and the fixing belt 33 may remain constant as described with reference to FIG. 7.

Figure 9:
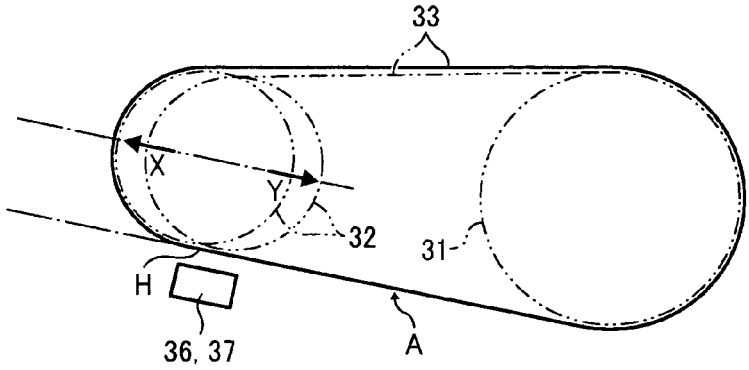
FIG. 9 is a view showing a state in which the heat roller moves in the fixing device according to another embodiment of the present invention.

FIG. 9 is a view showing another structure of the fixing device according to another embodiment of the present invention.

The embodiment as illustrated in FIG. 9 is different from the embodiment in FIG. 6 in that the heat roller 32 is configured to move in parallel with the lower flat surface of the fixing belt 33. Accordingly, a portion H on the outermost periphery A of the displacement area of the fixing belt 33 which displaces in accordance with the displacement of the heat roller 32 and parallel to the moving X- or Y-direction of the heat roller 32 exists at a lower side of the fixing belt 33.

Then, in the present embodiment, the thermistor 36 is provided at a portion opposite the portion H parallel to the moving direction of the heat roller 32 and below the heat roller 32, and opposite the fixing belt 33. Accordingly, when the heat roller 32 displaces in a direction approaches and withdraws from the fixing roller 31, the portion of the fixing belt 33 opposite the thermistor 36 expands or shortens in parallel with the moving X- or Y-direction of the heat roller 32, thereby retaining the distance between the thermistor 36 and the fixing belt 33 constant.

Figure 10:
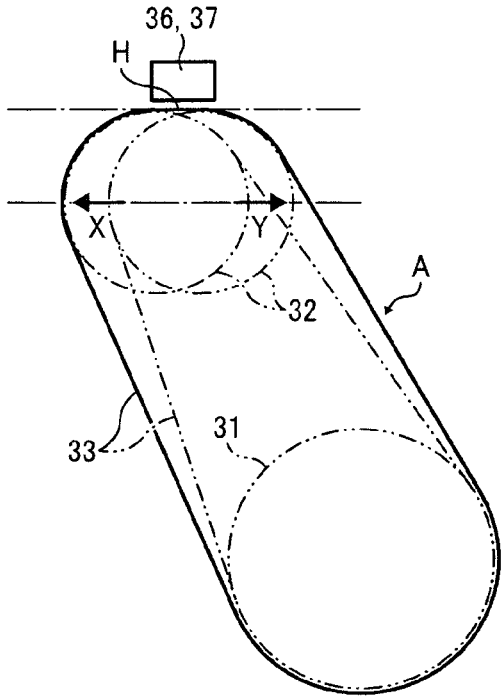
FIG. 10 is a view showing a state in which the heat roller moves in the fixing device according to yet another embodiment of the present invention.

FIG. 10 is a view showing yet another structure of the fixing device according to yet another embodiment of the present invention.

As illustrated in FIG. 10, the moving direction of the heat roller 32 is not set to be parallel to either of the flat surfaces of the fixing belt 33. However, even in this case, a portion H on the outermost periphery A of the displacement area of the fixing belt 33 which displaces in accordance with the displacement of the heat roller 32 and parallel to the moving X- or Y-direction of the heat roller 32 exists. Accordingly, the thermistor 36 can be provided at the portion H in parallel with the moving direction of the heat roller 32 and opposite the fixing belt 33.

Figure 11A:
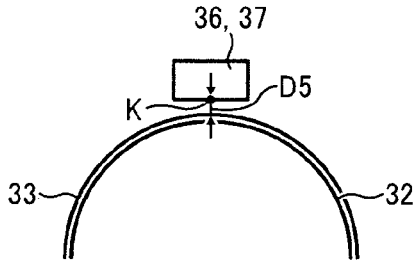
FIGS. 11A and 11B are enlarged views of a main part of the fixing device of FIG. 10.
Figure 11B:
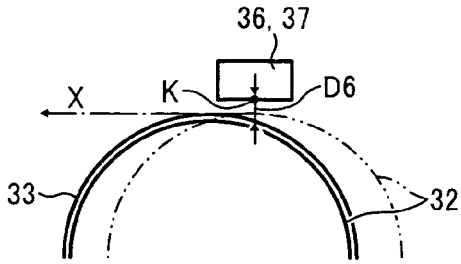
Figure 21:
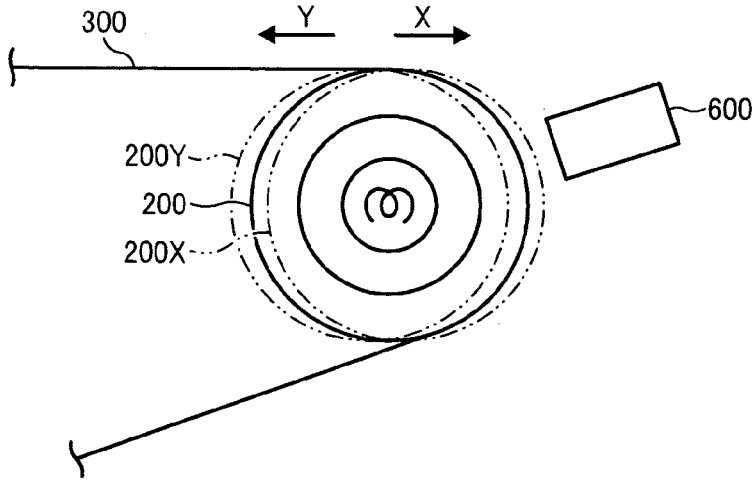
FIG. 21 RELATED ART
FIG. 21 is an enlarged view of a main part of a conventional fixing device.

In this case, since the thermistor 36 is provided opposite the curved portion of the fixing belt 33 wound around the heat roller 32, the distance D5 between the fixing belt 33 and the thermistor 36 slightly changes to the distance D6 when the heat roller 32 moves from a state as illustrated in FIG. 11A to a state as illustrated in FIG. 11B. However, this change in the distance is very small compared to the change in the distance in the conventional fixing device as illustrated in FIG. 21, and the change in the detection temperature by the thermistor 36 due to the change in the distance may be restricted within an allowable range.

For example, the present embodiment employs a thermostat 37 to cut off supply of electric current to the halogen heater 35 upon the ambient temperature of the fixing belt 33 reaching approximately 185° C. The thermostat 37 has an allowable range of ±5° C. in detecting temperature. The distance D between the thermostat 37 and the fixing belt 33 is set to be 1.1 mm. If the variations in the distance D are within ±0.3 mm, the detected temperature by the thermostat 37 can be restricted within the allowable range of ±5° C. In this case, by applying the structure of the present invention, the variations in the distance D between the thermostat 37 and the fixing belt 33 can be within ±0.3 mm, and therefore, the variations in the detected temperature by the thermostat 37 can be restricted within an allowable range for temperature detection.

To detect temperature with higher precision, as illustrated in FIGS. 6 and 9, it is preferable that the flat surface of the fixing belt 33 be parallel to the moving direction of the heat roller 32 and that the thermistor 36 be provided opposite the flat surface of the fixing belt 33.

It is to be noted that although the structure of the present invention is applied to the fixing device including a non-contact-type temperature detecting means (thermistor and thermostat), the structure of the present invention is also applicable to the fixing device including a contact-type temperature detecting means. Hereinafter, an embodiment will now be described in which the present invention is applied to the fixing device including a contact-type temperature detecting means.

Figure 12:
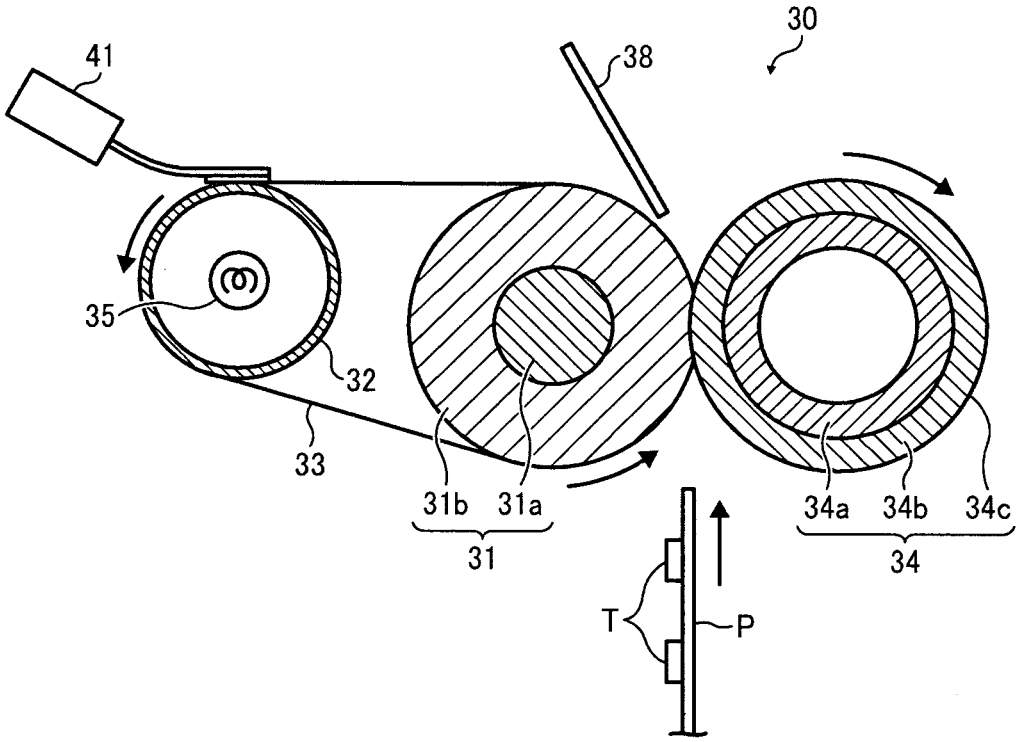
FIG. 12 is a view showing an embodiment in which the structure of the present invention is applied to a fixing device provided with a contact-type temperature detecting means.

The fixing device 30 as illustrated in FIG. 12 includes a contact-type thermistor 41 as a temperature detecting means to detect the temperature of the fixing belt 33, arranged in contact with the fixing belt 33. In FIG. 12, the thermistor 41 is brought into contact with a portion of the fixing belt 33 wound around the heat roller 32. Other parts and components such as the fixing roller 31, the heat roller 32, the fixing belt 33, the heat roller 34 and the like, each have the same structure as described in the aforementioned embodiment.

Figure 13:
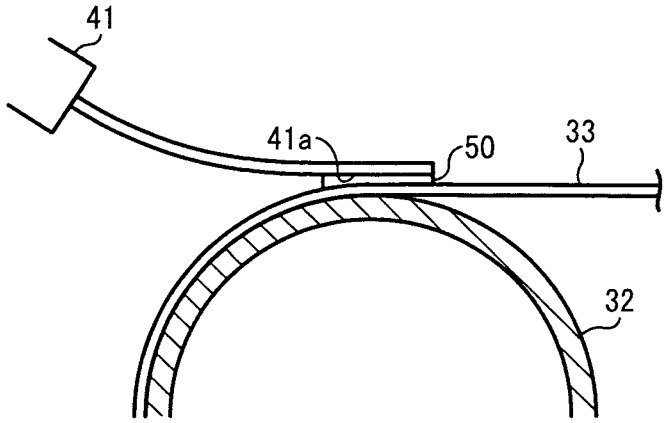
FIG. 13 is an enlarged view of a main part of the fixing device of FIG. 12.

FIG. 13 is an enlarged diagram showing where the thermistor 41 and the fixing belt 33 contact each other.

As illustrated in FIG. 13, in the present embodiment, a lubricant layer 50 formed of oil or the like is provided between a contact surface 41*a* of the thermistor 41 and the surface of the fixing belt 33, thus decreasing friction resistance between the contact surface 41*a* of the thermistor 41 and the surface of the fixing belt 33 and thereby reducing or preventing entirely abrasion of the fixing belt 33. In addition, by decreasing the friction resistance, scratches on the surface of the fixing belt 33 due to contact with the thermistor 41 may be prevented and the resulting stripe-like uneven brightness in the output image may be prevented. In particular, in a solid image formed with a lot of toner adhesion, occurrence of the stripe-like uneven brightness tends to be particularly noticeable. By coating the contact surface 41*a* of the thermistor 41 with lubricant as described above, occurrence of the uneven brightness in the solid image may be prevented effectively. The lubricant layer 50 may be formed such that the contact surface 41*a* is affixed with a solid oil layer (of a paste type) and the affixed layer is pressed down by the contact pressure.

When manufacturing the fixing device, the contact surface 41*a* of the thermistor 41 is coated with lubricant, thereby making it unnecessary to lubricate the surface of the fixing belt 33, and further, making it unnecessary to lubricate after assembly, thus streamlining manufacturing. In addition, lubricating the thermistor 41 before assembly enables forming a similar lubricant layer 50 for each fixing device between the contact surface 41*a* of the thermistor 41 and the surface of the fixing belt 33, and realizes a uniform performance of the device.

Figure 14:
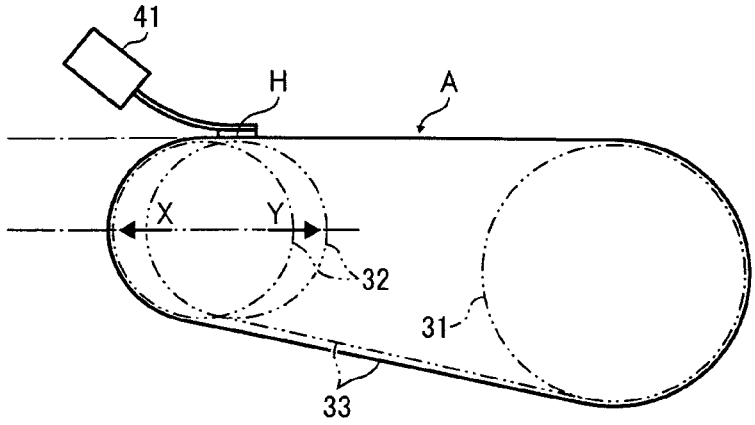
FIG. 14 is a view showing a state in which the heat roller moves in the fixing device of FIG. 12.

FIG. 14 is a diagram showing a state in which the heat roller 32 moves in the fixing device as illustrated in FIG. 12. In FIG. 14, the illustration of the heat roller 34 and the separation plate 38 are omitted.

In the present embodiment, the moving direction of the heat roller 32 is formed parallel to the upper, flat surface of the fixing belt 33. Accordingly, a portion H on the outermost periphery A of the displacement area of the fixing belt 33 which displaces in accordance with the displacement of the heat roller 32 and parallel to the moving X- or Y-direction of the heat roller 32 exists at an upper side of the fixing belt 33. Then, the thermistor 41 is provided at the portion H to be parallel to the moving direction of the heat roller 32 and opposite the heat roller 32, and contacting the fixing belt 33 via the lubricant layer.

Figure 15A:
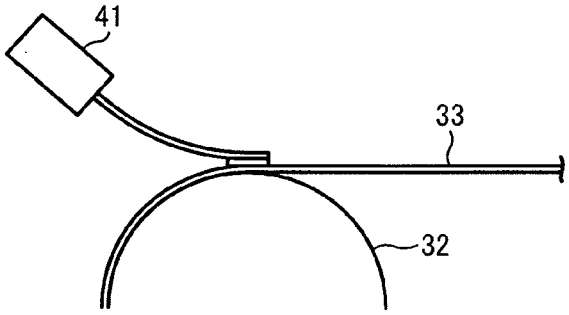
FIGS. 15A and 15B are enlarged views of a main part of the fixed device of FIG. 12.
Figure 15B:
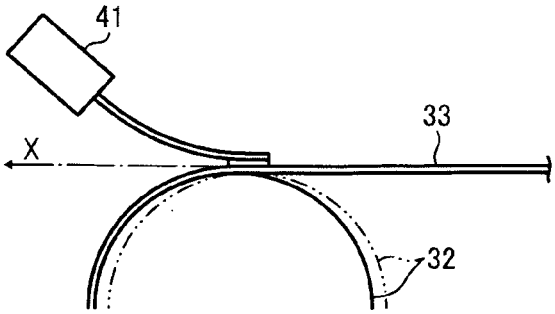

Accordingly, when the heat roller 32 displaces from a state as illustrated in FIG. 15A to a state as illustrated in FIG. 15B, the portion of the thermistor 41 contacting the fixing belt 33 expands in parallel with the moving X-direction of the heat roller 32, and therefore, the contact pressure of the thermistor 41 before and after the displacement does not change. Similarly, even when the fixing belt 33 shortens and the heat roller 32 displaces in the reverse direction, the portion of the thermistor 41 contacting the fixing belt 33 shrinks in parallel with the moving X-direction of the heat roller 32, and therefore, the contact pressure of the thermistor 41 before and after the displacement does not change. Thus, as described above, the contact pressure between the thermistor 41 and the fixing belt 33 remains constant even when the heat roller 32 displaces in the present embodiment.

Figure 16A:
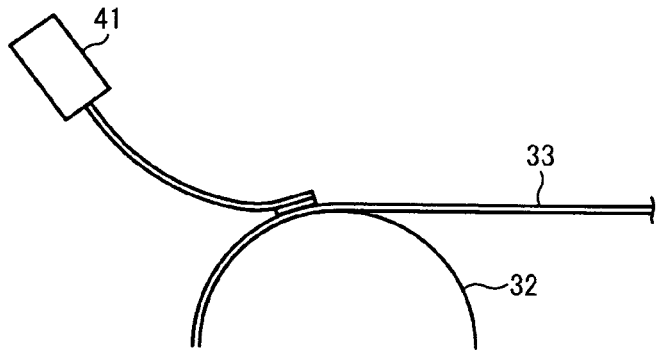
FIGS. 16A and 16B are other enlarged views of a main part of the fixed device of FIG. 12.
Figure 16B:
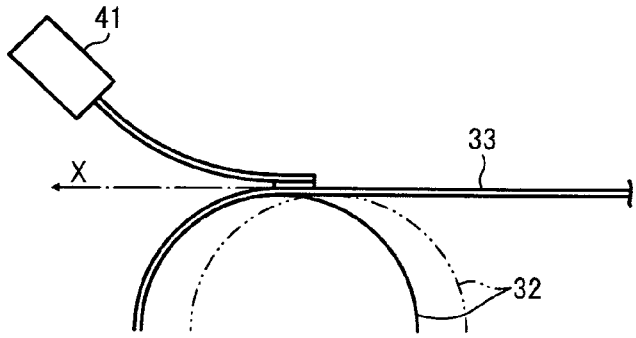

As illustrated in FIG. 16A, when the thermistor 41 is provided at a curved portion of the fixing belt 33 wound around the heat roller 32, if the heat roller 32 moves as illustrated in FIG. 16B, the thermistor 41 rides on the flat surface from the curved surface, whereby the contact pressure before and after the displacement slightly changes. This change in the contact pressure may affect the accuracy of temperature detection of the thermistor 41. However, by adjusting the contact position of the thermistor 41, the effect may be restricted within an allowable range. Further, in a case in which the heat roller 32 moves toward the X-direction in the figure from the state as illustrated in FIG. 16B, the contact pressure between the thermistor 41 and the fixing belt 33 may be kept constant as described above.

If the moving direction of the heat roller 32 is configured to be parallel to the lower flat surface of the fixing belt 33 as illustrated in FIG. 9, the thermistor 41 may be brought into contact with the fixing belt 33 at a portion H parallel to the lower side of the fixing belt 33. In this case also, even when the heat roller 32 moves, the contact pressure between the thermistor 41 and the fixing belt 33 remains constant.

Figure 17:
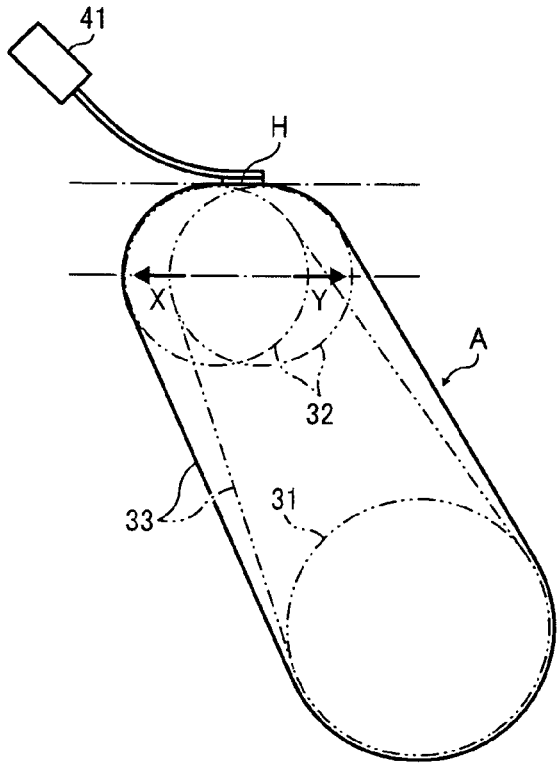
FIG. 17 is a view showing a structure of another embodiment in the fixing device provided with a contact-type temperature detecting means.

FIG. 17 shows another structure of the fixing device including a contact-type thermistor 41 according to a further embodiment of the present invention.

The structure as illustrated in FIG. 17 is the same as that in FIG. 10 except that a contact-type thermistor 41 is provided. Accordingly, there exists a portion H on the outermost periphery A in the displacement area of the fixing belt 33 that moves in accordance with the moving of the heat roller 32 and parallel to the moving direction of the heat roller 32. Then, in the present embodiment, the thermistor 41 is provided in contact with the fixing belt 33 at the portion H parallel to the moving direction of the heat roller 32.

Figure 18A:
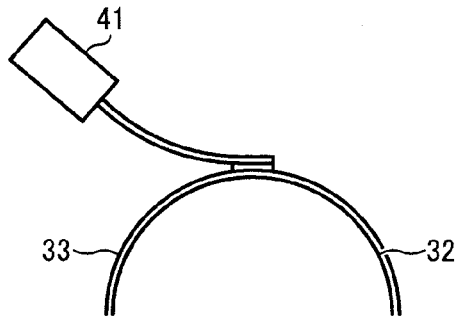
FIGS. 18A and 18B are enlarged views of a main part of the fixing device of FIG. 17.
Figure 18B:
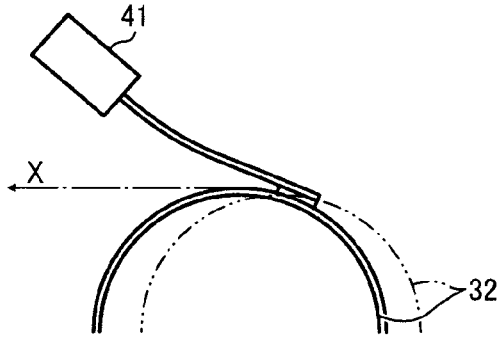

In this case, since the thermistor 41 contacts the curved surface of the fixing belt 33 wound around the heat roller 32, when the heat roller 32 displaces from a state as illustrated in FIG. 18A to a state as illustrated in FIG. 18B, the contact pressure of the thermistor 41 slightly changes. However, since this change in the contact pressure is minimal, the change in the detection temperature of the thermistor 41 due to the change in the contact pressure may be held within an allowable range of the detection temperature.

However, in order to detect temperature more precisely, as illustrated in FIG. 12, it is preferable that the flat portion of the fixing belt 33 be provided parallel to the moving direction of the heat roller 32, and that the thermistor 41 be contacted to the flat portion of the fixing belt 33.

Although preferred embodiments of the present invention have been described above, the present invention is not limited thereto and additional modifications and variations of the present invention are possible in light of the above teachings.

Figure 19:
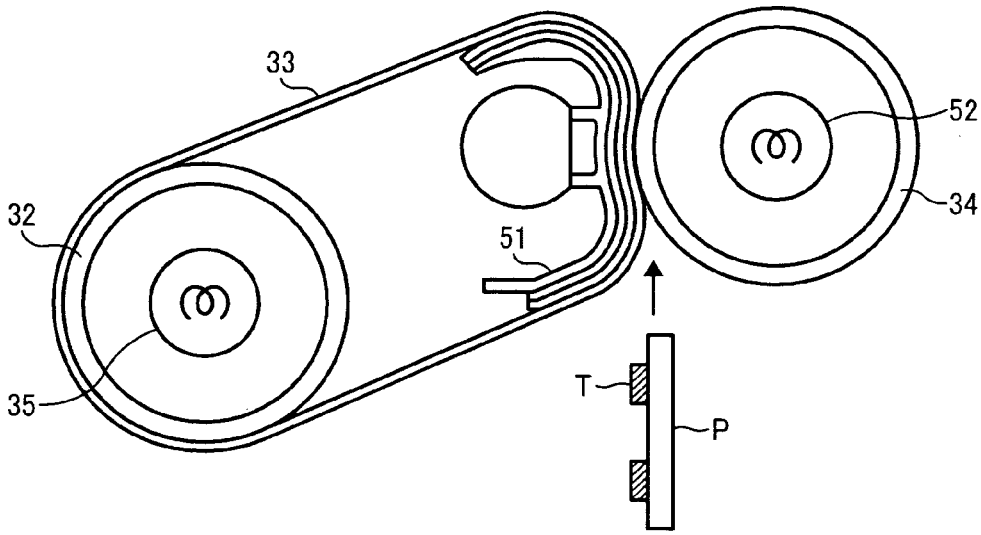
FIG. 19 is a general cross-sectional view of a fixing device including a fixing pad.
Figure 20:
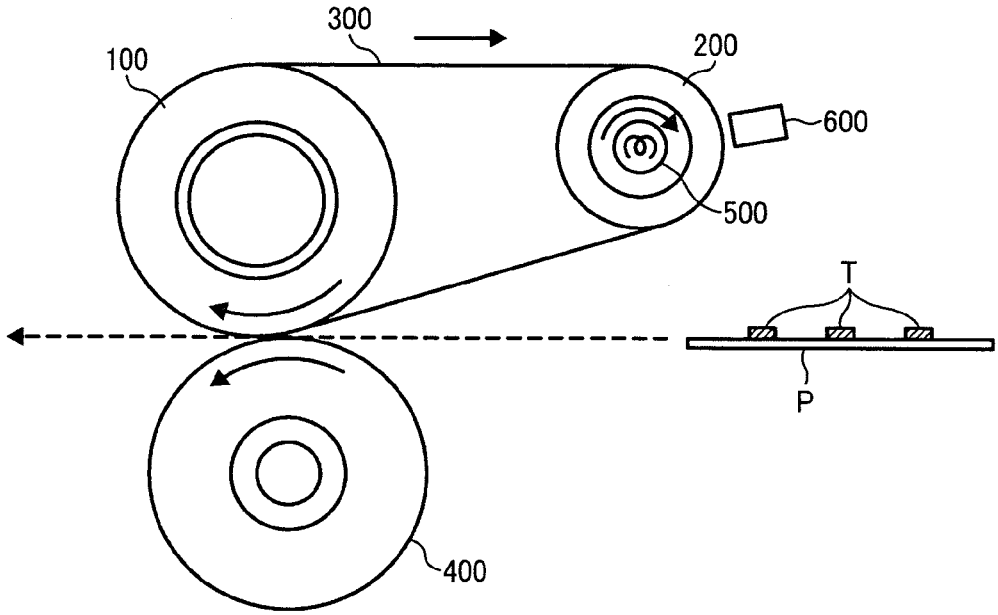
FIG. 20 RELATED ART
FIG. 20 is a general configuration of a conventional fixing device.

For example, as illustrated in FIG. 19, the present invention may be applied to a fixing device that employs a non-rotatable fixing pad 51 as a fixing member, instead of the fixing roller. In this case, the pressure roller 34 is driven to rotate and the fixing belt 33 and the heat roller 32 are driven to rotate accompanied by the rotation of the pressure roller 34. In addition, a heater 52 as a heat source may be provided inside the heat roller 34.

The pressure roller 34 and the heat roller 32 may be formed of a non-rotatable pressure member and heating member, respectively. In this case, what is required is to rotate the fixing belt 33 by the rotation of at least one of the fixing member, the heating member, and the pressure member. A structure in which a pressure belt is used as a nip forming member, and the fixing belt is pressed by the pressure belt via the pressure roller or the pressure pad and the like, is also possible. The nip forming member is not limited to a structure that presses against the fixing belt, and may be configured to simply contact the fixing belt without pressing against it.

The fixing device of the present invention is not limited to that which is mounted in the color image forming apparatus as illustrated in FIG. 1, and may be applied to a monochrome image forming apparatus, a copier, a printer, a facsimile machine, and a multifunctional machine combining the above functions.

As described above, the fixing device in the embodiments of the present invention may retain the distance or the contact pressure of the temperature detecting means with respect to the fixing belt at a constant level, even when the heat roller displaces due to the expansion or shrinkage of the fixing belt. That is, in the structure of the present invention, even when the heat roller displaces from a first position to a second position in the movable area of the heat roller, the temperature detecting means is arranged so that the distance or the contact pressure of the temperature detecting means with respect to the fixing belt is retained substantially constant. Herein, "substantially constant" includes a case in which the distance is strictly coincident as well as a case in which the distance changes within an allowable range for the temperature detection.

Therefore, variations in the detected temperature of the temperature detecting means may be restricted within the allowable range. Thus, the temperature of the fixing belt can be detected with higher precision, and malfunction of the apparatus due to erroneous detection of the temperature detecting means may be prevented. In addition, scratches on the fixing belt caused due to too-tight contact with the temperature detecting means may be prevented. According to the present invention, malfunction of the apparatus and scratches on the fixing belt can be prevented, thereby enabling provision of a highly reliable fixing device and image forming apparatus.

Further, according to the present invention, by providing the temperature detecting means at a predetermined position relative to the fixing device, the temperature of the fixing belt can be detected with higher precision, thus simplifying the structure of the apparatus to achieve a compact, low-cost apparatus.

Additional modifications and variations of the present invention are possible in light of the above teachings. It is therefore to be understood that, within the scope of the appended claims, the invention may be practiced other than as specifically described herein.

What is claimed is:

1. A fixing device comprising:

a fixing member;

a heating member configured to approach and withdraw from the fixing member;

an endless fixing belt, wound around the fixing member and the heating member, configured to be driven to rotate;

a nip forming member to form a nip while contacting the fixing belt at a position opposite the fixing member;

a pressing member to press the heating member so as to separate it from the fixing member; and a temperature detector to detect a temperature of the fixing belt at a position opposite the heating member, positioned such that one of a distance and a contact pressure between the temperature detector and the fixing belt remains substantially constant as the heating member approaches and withdraws from the fixing member, wherein the temperature detector is a thermistor in contact with the fixing belt, and a contact surface of the thermistor with the fixing belt is coated with a lubricant.

2. The fixing device as claimed in claim 1, wherein the pressing member presses the heating member in a direction substantially parallel to the moving direction of the heating member as the heating member approaches and withdraws from the fixing member.

3. The fixing device as claimed in claim 1, wherein a flat surface of the fixing belt is arranged in parallel with the moving direction of the heating member as the heating member approaches and withdraws from the fixing member, and the temperature detector is provided opposite or in contact with the flat surface thereof.

4. The fixing device as claimed in claim 1, wherein the temperature detector is provided above the heating member.

5. The fixing device as claimed in claim 1, wherein a plurality of temperature detectors is provided along a longitudinal direction of the heating member.

6. The fixing device as claimed in claim 1, wherein the temperature detector is provided in contact with the fixing belt.

7. The fixing device as claimed in claim 1, wherein the temperature detector is positioned at a predetermined distance from the fixing belt.

8. The fixing device as claimed in claim 1, wherein the temperature detector is a thermostat.

9. The fixing device as claimed in claim 1, wherein the heating member is a hollow cylindrical roller member having a wall thickness of 1 mm or less.

10. The fixing device as claimed in claim 1, further comprising a separation member provided in non-contact with the fixing belt to separate a recording sheet from a surface of the fixing belt.

11. An image forming apparatus comprising a fixing device as claimed in claim 1.

12. A fixing device comprising:

a fixing member;

a heating member configured to be approach and withdraw from the fixing member;

an endless fixing belt, wound around the fixing member and the heating member, configured to be driven to rotate;

a nip forming member to form a nip while contacting the fixing belt at a position opposite the fixing member;

a pressing member to press the heating member so as to separate from the fixing member; and a temperature detector to detect a temperature of the fixing belt at a position opposite the heating member, provided at a position opposite or in contact with the fixing belt along an outermost periphery of a displacement area of a surface of the fixing belt which displaces in accordance with the moving of the heating member as the heating member approaches and withdraws from the fixing member and parallel to the moving direction of the heating member, wherein the temperature detector is a thermistor in contact with the fixing belt, and a contact surface of the thermistor with the fixing belt is coated with a lubricant.

13. The fixing device as claimed in claim 12, wherein the pressing member presses the heating member in a direction substantially parallel to the moving direction of the heating member as the heating member approaches and withdraws from the fixing member.

14. The fixing device as claimed in claim 12, wherein a flat surface of the fixing belt is arranged in parallel with the moving direction of the heating member as the heating member approaches and withdraws from the fixing member, and the temperature detector is provided opposite or in contact with the flat surface thereof.

15. A fixing device comprising:

a fixing member;

a heating member configured to approach and withdraw from the fixing member;

a support member that supportingly receives each of the fixing member and the heating member;

an endless fixing belt, wound around the fixing member and the heating member, configured to be driven to rotate;

a pressing member to press the heating member so as to separate it from the fixing member; and a temperature detector to detect a temperature of the fixing belt at a position opposite the heating member, positioned such that one of a distance and a contact pressure between the temperature detector and the fixing belt remains substantially constant as the heating member approaches and withdraws from the fixing member, wherein the heating member is movable within the support member.

16. The fixing device as claimed in claim 15, wherein the heating member is movable relative to the fixing member independent of the temperature detector.

17. The fixing device as claimed in claim 15, wherein the heating member is movable relative to the temperature detector.

* * * * *